United States Patent [19]

Belknap et al.

[11] 4,340,180

[45] Jul. 20, 1982

[54] NOZZLE MIXING LINE BURNER

[75] Inventors: James L. Belknap, Parker City; William P. Coppin, Muncie, both of Ind.

[73] Assignee: Maxon Corporation, Muncie, Ind.

[21] Appl. No.: 212,346

[22] Filed: Dec. 3, 1980

[51] Int. Cl.[3] ..... B05B 7/08

[52] U.S. Cl. ..... 239/422; 239/426; 431/353; 432/222

[58] Field of Search ..... 239/422, 426, 431, 543, 239/545, 556; 432/222; 431/353

[56] References Cited

U.S. PATENT DOCUMENTS

| | | | |
|---|---|---|---|
| Re. 26,244 | 8/1967 | Spielman | 263/19 |
| 3,064,720 | 11/1962 | Keating et al. | 432/222 X |
| 3,494,711 | 2/1970 | Spielman | 431/165 |

FOREIGN PATENT DOCUMENTS

| | | | |
|---|---|---|---|
| 52-24337 | 2/1977 | Japan | 431/353 |

*Primary Examiner*—Robert B. Reeves
*Assistant Examiner*—Paul A. Sobel
*Attorney, Agent, or Firm*—Robert M. Ward

[57] ABSTRACT

The present invention provides an improved nozzle mixing line burner for automatically increasing available oxygen for combustion as the fuel gas flow rate increases. This improved nozzle mixing line burner includes a pair of fuel gas manifolds, each of which has a row of gas discharge ports discharging laterally and toward the opposite manifold to provide streams of fuel gas. An orifice plate extends between the fuel gas manifolds and includes a plurality of rows of air orifices extending along the line of the burner, with the air orifices closest to the gas manifolds being relatively smaller in size and the more internally disposed rows of air orifices increasing in orifice size toward the middle of the orifice plate, to increase the available air supply proportionately as the velocity of the fuel gas flow increases.

14 Claims, 11 Drawing Figures

NOZZLE MIXING LINE BURNER

BACKGROUND OF THE INVENTION

The present invention relates in general to line burners and more particularly to an improved nozzle mixing line burner for automatically increasing available oxygen for combustion as the fuel gas flow rate increases.

In the prior art, burners which extend longitudinally and contain a plurality of fuel gas openings and combustion air openings along the length of the burner are known as "line burners". The line burner may be used in diverse situations where the heating application requires a specified temperature distribution over a given area. Various prior art line burners have been applicable for use in a wide variety of different burner configurations which has contributed to their flexibility. However, the line burners of the prior art have not been without their difficulties in flexibility of application for some uses, ability to accommodate varying fuel gases and combustion air flow rates, inter alia. Frequently, manufacturers of prior art line burners have been obliged to produce a wide variety of different and separate types of equipment for each separate application, which has increased the cost of research, development and engineering of the systems, the production cost, and the cost to the user.

In view of the difficulties and deficiencies of such prior art line burners, it is an object of the improved nozzle mixing line burner of the present invention to ameliorate the same.

It is also an object of the present invention to provide an improved nozzle mixing line burner which is susceptible to modular production and utilization.

It is a further object of the improved nozzle mixing line burner of the present invention to burn virtually any clean gaseous fuel and with improved heat release characteristics.

It is also a further object of the improved nozzle mixing line burner of the present invention to provide line burners of maximum flexibility for fresh or recirculated process air heating, and for installation in a wide variety of air source circumstances, in order that a system may be custom tailored to the customer's specifications and needs, all at reduced cost.

It is a yet further object of the improved nozzle mixing line burner of the present invention to provide a novel apparatus of increased efficiency, but of decreased complexity.

It is a yet further additional object of the improved nozzle mixing line burner of the present invention to provide a burner which automatically increases, and without valves or other moving parts, the available oxygen for increased fuel gas flow rates.

SUMMARY OF THE INVENTION

The improved nozzle mixing line burner of the present invention functions to automatically increase oxygen for increased fuel gas flow rates. The structure for accomplishing the same includes a novel manifold and orifice plate configuration. A pair of fuel gas manifolds which are oppositely disposed in spaced consideration are provided. Each of the fuel gas manifolds extends longitudinally along the line of the burner, and each fuel gas manifold has a plurality of fuel gas ports discharging laterally and toward the opposite manifold, to provide streams of fuel gas. In preferred embodiments the fuel gas ports are in even rows, one row on each fuel gas manifold. The fuel gas ports are preferably of uniform size, are preferably circular in shape, and preferably an equal number of such ports is provided in each manifold. Means are provided connected to the fuel gas manifolds for supplying a fuel gas thereto.

An orifice plate is provided extending longitudinally along the line of the burner and between the pair of fuel gas manifolds. The orifice plate is disposed upstream of the gas discharge ports of said fuel gas manifolds, and has air orifices therein for providing from available air, streams of air transverse to the fuel gas streams which are directed laterally from the fuel gas manifold ports.

The air orifices are provided in at least two rows of relatively smaller air orifices extending longitudinally along the line of the burner, relatively proximate the fuel gas manifolds and preferably disposed adjacent the fuel gas ports. At least one row, and preferably two rows, of relatively larger air orifices are provided to extend longitudinally between the rows of relatively smaller air orifices. In other preferred embodiments, at least one yet larger row of air orifices may extend between the rows of larger air orifices and longitudinally along the line of the burner. Preferably, the orifices of various sizes are disposed in-line as viewed laterally.

The functioning of this stepped array of air orifices increasing in size toward the middle of the burner is to increase the available oxygen in proportion to the increased velocity, and hence stream length, of the fuel gas flow for flexibility of application and for preventing the air/gas mixture from becoming too rich or too lean for optimum burning.

DETAILED DESCRIPTION OF PREFERRED EMBODIMENTS

Figure 1:
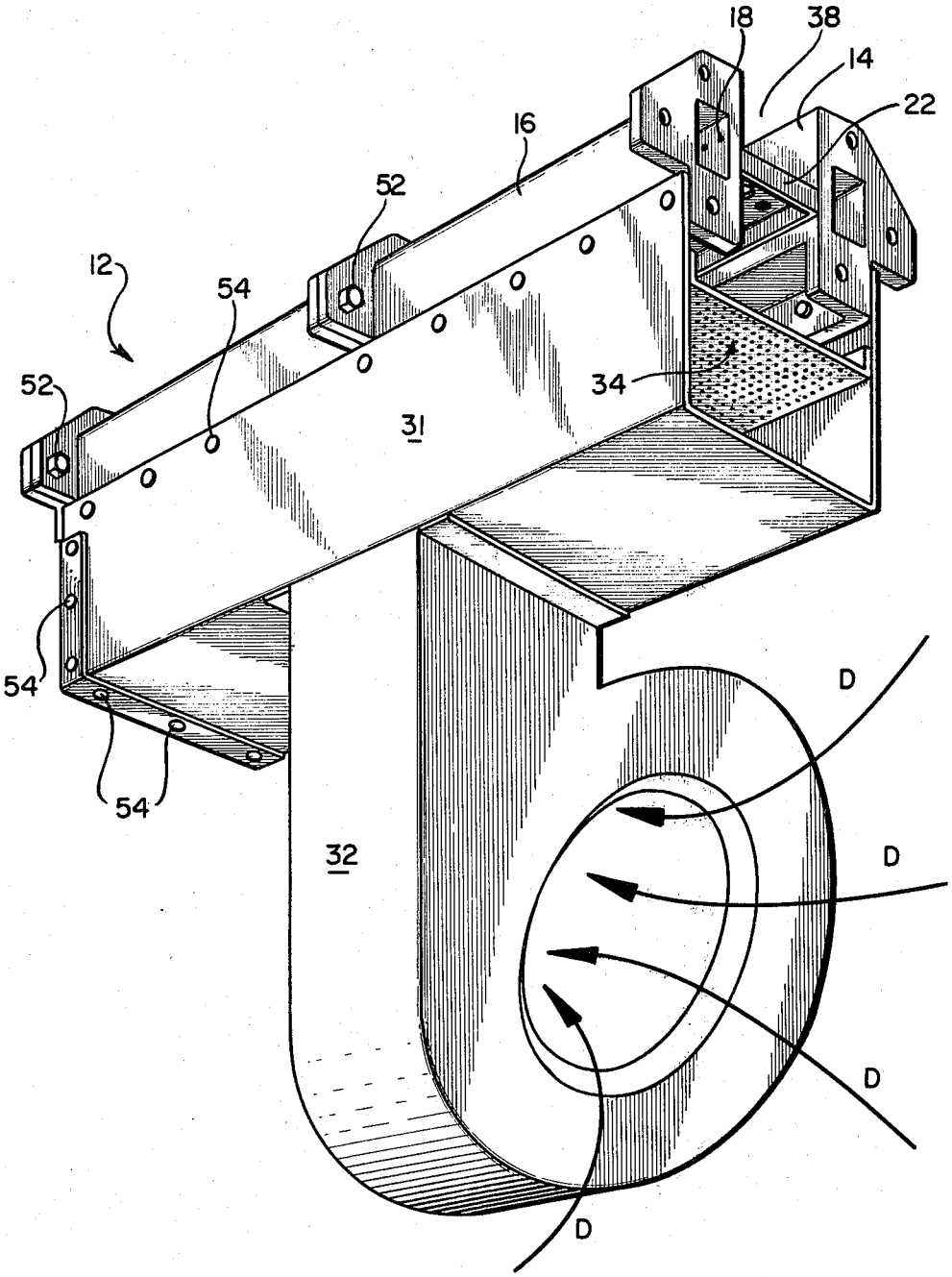
FIG. 1 is a perspective view of one embodiment of the improved nozzle mixing line burner of the present invention, and shows a pair of gas manifolds oppositely disposed and extending longitudinally along the line of the burner, an orifice plate extending between the pair of gas manifolds containing air orifices therein, an air manifold extending longitudinally along the line of the burner and having a diffuser plate extending longitudinally along the line of the burner and upstream of the air orifices, with a blower for collecting air and supplying the same to the air manifold.

The improved nozzle mixing line burner of the present invention provides fuel gas manifolds and an accompanying orifice plate structure for automatically increasing the available oxygen when the fuel gas flow rate increases to provide a proper fuel gas/oxygen ratio for optimum combustion.

A pair of fuel gas manifolds are oppositely disposed in spaced relationship to each other. Each of the fuel gas manifolds extends longitudinally along the line of the burner, and each fuel gas manifold has a plurality of fuel gas ports discharging laterally and toward the opposite manifold to provide streams of the fuel gas. Fuel gas supply means are provided connected to the fuel gas manifolds for supplying the fuel gas thereto. In preferred embodiments, the fuel gas supply means includes a bifurcated pipe, each branch thereof being connected to an adjoining end of a fuel gas manifold. In these preferred embodiments, the opposite end of the fuel gas manifold is sealed.

An orifice plate is provided extending longitudinally along the line of the burner, between the pair of fuel gas manifolds, and upstream of the fuel gas manifolds. Air orifices are provided in the orifice plate for providing from available air, streams of air transverse to the fuel gas streams which are directed laterally from the fuel gas manifold ports. The air orifices comprise at least two rows of relatively smaller air orifices extending longitudinally along the line of the burner and relatively proximate each of the fuel gas manifolds. The air orifices further comprise at least one row, and preferably two rows, of relatively larger air orifices longitudinally extending between the rows of relatively smaller air orifices. This structure provides means whereby, as the velocity of the fuel gas flow is increased, the laterally and internally directed streams thereof extend to the vicinity of the relatively larger air orifices to provide proportionately increased oxygen for the combustion of the increased fuel gas present.

In alternative preferred embodiments, supplemental air means for supplying supplemental air to the orifices of the orifice plate may be provided. These supplemental air means preferably comprise means defining an air manifold which extends longitudinally along the line of the burner for directing air to the orifices of the orifice plate. Blower means connected to the air manifold for supplying air thereto at greater velocities may also be utilized. In further alternative embodiments, the blower means may be omitted and ducting to an outside source of air relatively rich in oxygen may be provided. These supplemental air means may yet further comprise in preferred embodiments air diffuser means disposed within the air manifold for controlled and even flow of air to the air orifices of the orifice plate. Such diffuser means are preferably provided in the form of a diffuser plate extending longitudinally along the line of the burner and disposed upstream of the air orifices. Such diffuser plate preferably has a multiplicity of perforations therein extending along the length thereof for promoting uniformity of air flow to the air orifices. In these alternative preferred embodiments, an air duct is connected to the air manifold at a point approximately equidistant the longitudinal ends of the burner for enhancement of uniformity of air flow along the length of the burner.

The above described fuel gas ports of the fuel gas manifold are preferably provided in at least one pair of rows disposed facing each other. In preferred embodiments, a single row is provided on each gas manifold, and each such row is preferably disposed at substantially the same distance from the orifice plate. Also, preferably the same number of gas ports is provided, and each individual gas port is of substantially the same size and is preferably circular in shape.

The relatively larger air orifices as set forth above preferably comprise two rows, each of which extends longitudinally between the rows of the relatively smaller air orifices. At least one row of yet larger air orifices longitudinally extending between the rows of the larger air orifices may be provided, and two rows of yet larger air orifices may be provided. Of course, other arrangements, shapes and sizes of equivalent functionality and result are contemplated. These alternative embodiments include staggering the various sized air orifices in the transverse dimension. In the lateral dimension the air orifices of the various sizes are disposed in straight line configuration beneath or to the side of the gas stream of a corresponding fuel gas port in alternative embodiments for cooperative operational relationship therewith.

The nozzle mixing line burner of the present invention may be utilized in embodiments without the air manifold and diffuser plate when installed outside the firing duct with the effluent stream directed laterally of and downstream the flame. These embodiments may also be disposed within effluent streams having sufficient oxygen for combustion and preferably a sufficient aperture is provided for flow of the effluent stream around the line burner to prevent a negative pressure.

Embodiments utilizing the air manifold with the accompanying air diffuser plate may be installed within the effluent stream, and where such effluent stream is deficient in oxygen an external air feed may be supplied thereto. In such instances, a sufficient aperture is provided around the line burner. Where the effluent stream contains sufficient oxygen for combustion, but is low in velocity, a blower may be provided to increase the low velocity air of the effluent stream for force directing the same into the line burner.

In other preferred embodiments, wherein the line burner is installed outside the heating duct and with the effluent stream disposed downstream thereof, blower means may be provided in conjunction with the air manifold and the air diffuser plate means.

The nozzle mixing line burner of the present invention is adapted for modular construction and may be disposed in a wide variety of line configurations, including, inter alia, T-shapes, cross-shapes, L-shapes, H-shapes, and various irregular shapes depending on the customer's temperature, distribution and other needs.

Figure 2:
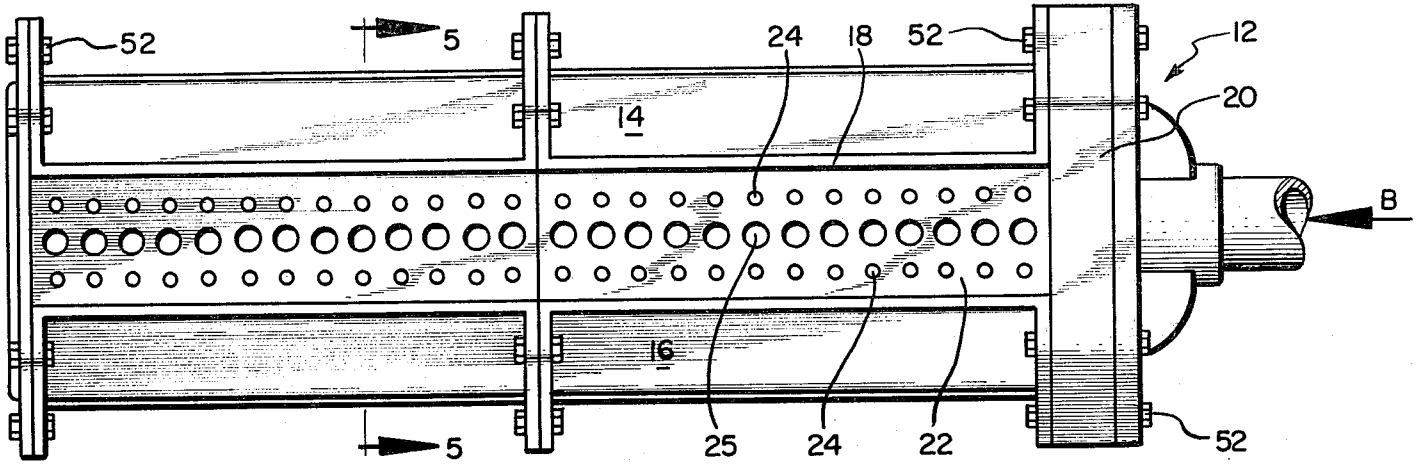
FIG. 2 is an enlarged plan view of the improved nozzle mixing line burner of the present invention showing the pair of laterally and oppositely disposed fuel gas manifolds with an orifice plate extending therebetween, the orifice plate containing a pair of rows of relatively smaller orifices located adjacent the fuel gas manifolds and a centrally located row of relatively larger orifices.
Figure 5:
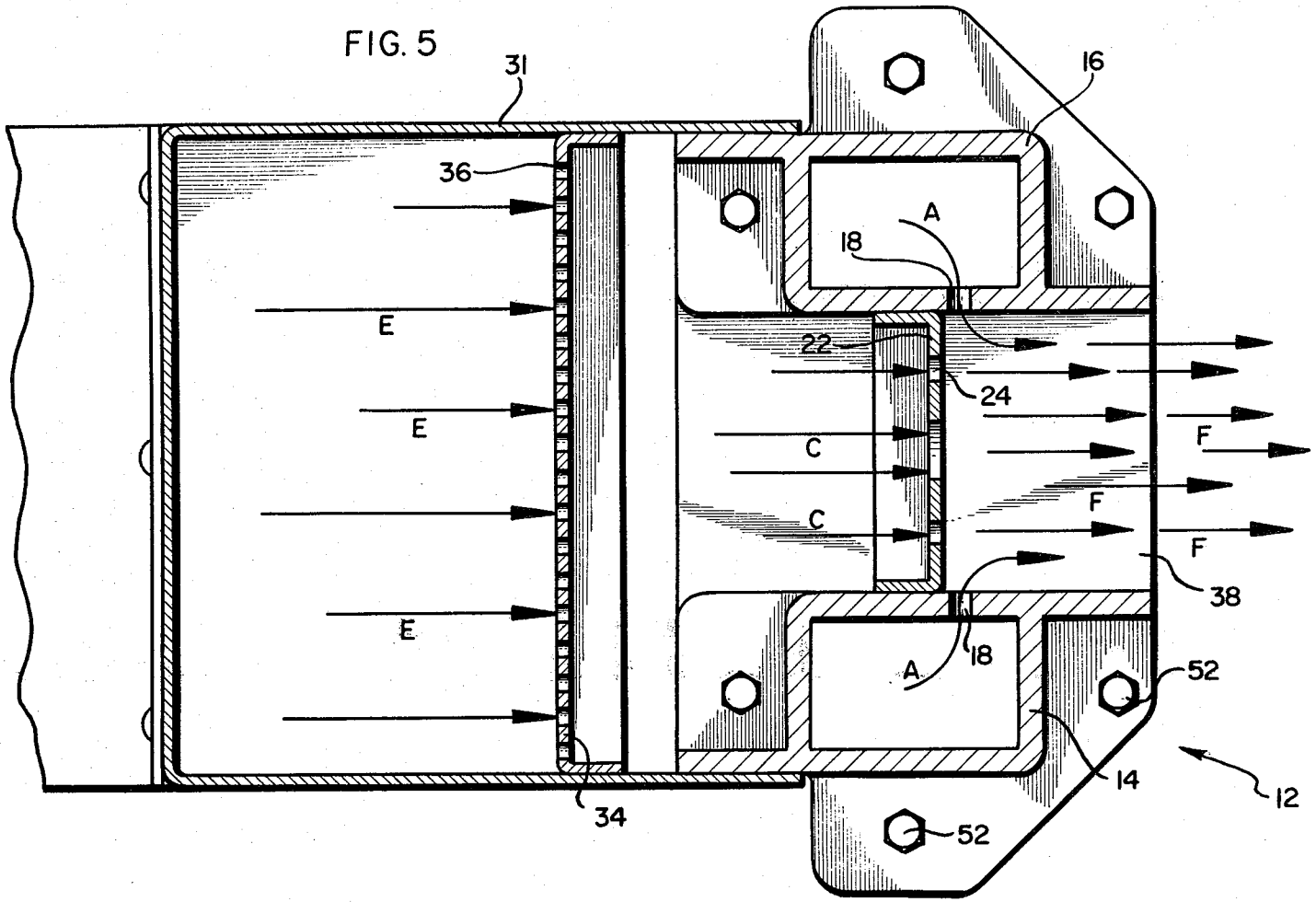
FIG. 5 is an enlarged cross-sectional view taken along lines 5—5 of FIG. 2 and showing the path of air through the diffuser plate and into the air chamber for exiting through the air orifices and to be mixed with the fuel gas being emitted from the laterally directing openings in the fuel gas manifold where combustion occurs.

Referring now to the drawing and to FIG. 1 in particular. The improved nozzle mixing line burner of the present invention is generally shown at 12. Referring also to FIG. 2, a pair of fuel gas manifolds 14, 16 are oppositely disposed in spaced relationship. Each of the fuel gas manifolds 14, 16 extends longitudinally along the line of the burner 12. Each of the fuel gas manifolds 14, 16 includes a plurality of fuel gas ports 18 as shown in FIGS. 1 and 5. The fuel gas ports 18 discharge laterally and towards the opposite manifold as shown in FIG. 5 at Arrows A to provide streams of fuel gas. The fuel gas enters the fuel gas manifolds 14, 16 as shown in FIG. 2 at Arrow B and is directed into gas distributor 20, which is not shown in the view of FIG. 1 for clarity.

An orifice plate 22 extends longitudinally along the line of burner 12 as shown particularly in FIG. 2 and between the pair of fuel gas manifolds 14, 16. Air orifices 24 through 30 are provided in orifice plate 22 for providing from available air streams of air, as shown particularly at Arrows C in FIG. 5. The streams of air provided through orifices 24 through 30 as shown in FIG. 5 at Arrow C, provide air to the fuel streams directed laterally from the fuel gas manifold ports 18 as shown at Arrows A in FIG. 5.

Figure 4:
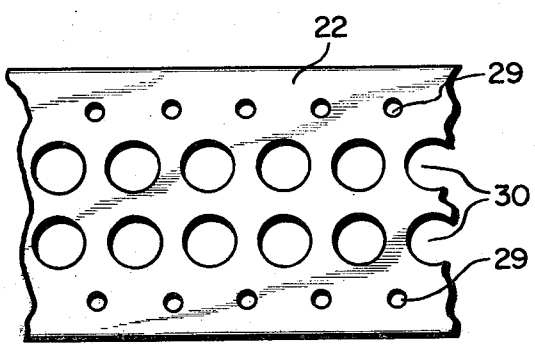
FIG. 4 is a fragmented and greatly enlarged section of an alternative embodiment of an orifice plate showing 4 rows of air orifices with the more centrally disposed air orifices increasing in size; and staggered in the transverse dimension with respect to the more externally disposed rows.
Figure 3:
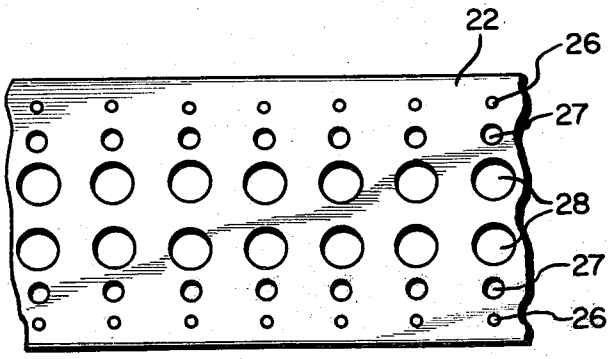
FIG. 3 is a fragmented and greatly enlarged section of an alternative embodiment of an orifice plate showing 6 rows of air orifices with the more centrally disposed air orifices increasing in size.

Various configurations of the air orifices are shown in FIGS. 2, 3, and 4 as being exemplary, but without unnecessary limitation. In the embodiment of FIG. 2, at least two rows of relatively smaller air orifices 24 extend longitudinally along the line of the burner in relatively proximate disposition with each of the fuel gas ports 18. In this embodiment at least one row of relatively larger air orifices 25 extends longitudinally between the rows of relatively smaller air orifices 24. Thus, as the velocity of the fuel gas flow (see Arrows A of FIG. 5) increases, the laterally and internally directed streams thereof extend to the vicinity of the relatively larger air orifices 25 to provide proportionately increased oxygen for the combustion of the increased fuel gas flow.

As shown in FIG. 3, a pair each of first, second and third rows of air orifices of increasing diameter, respectively 26, 27, 28, are provided. In FIG. 4 a different arrangement is shown, wherein rows 29 and 30 of such air orifices are provided. Other arrangements are contemplated as well.

Means for supplying supplemental air to the various air orifices 24 through 30 is provided preferably in the form of an air manifold 31 as shown particularly in FIGS. 1 and 5. Air manifold 31 extends longitudinally along the line of the burner 12 for directing air to the air orifices 24 through 30 of the orifice plate 22. A blower means 32 may also be connected to the air manifold 31 for supplying air thereto, as shown at Arrows D of FIG. 1.

In preferred embodiments, air diffuser means for controlling the flow of air to the air orifices 24 through 30 of the orifice plate 22 are provided. The diffuser means preferably comprise the diffuser plate 38 as shown especially in FIGS. 1 and 5. The diffuser plate 34 has a multiplicity of perforations 36 therein. These perforations 36 extend along the length of the diffuser plate 34 for promoting uniformity of air flow to the air orifices 24 through 30. Air enters the multiplicity of perforations 36 in diffuser plate 34 from air manifold 31, as shown at Arrows E of FIG. 5.

Figure 6:
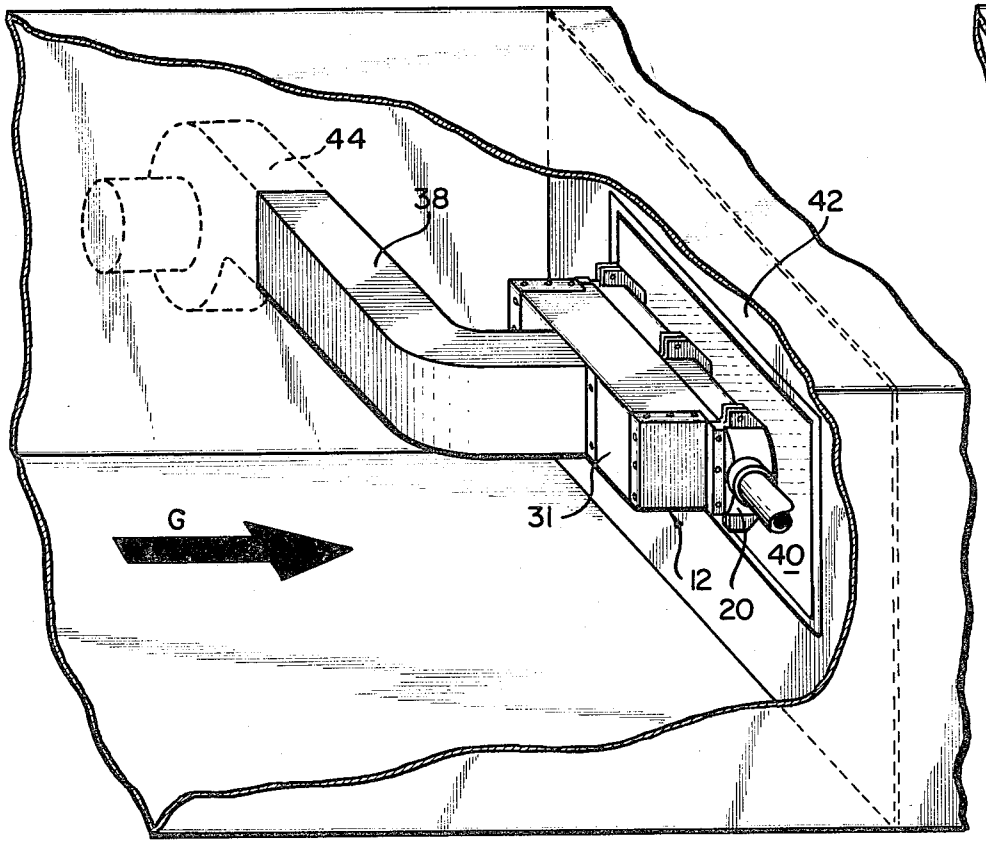
FIG. 6 is a perspective view of one embodiment of the improved nozzle mixing line burner of the present invention including an air manifold and installed within an air stream which is deficient in oxygen, wherefore air rich in oxygen is supplied from outside the effluent stream.
Figure 8:
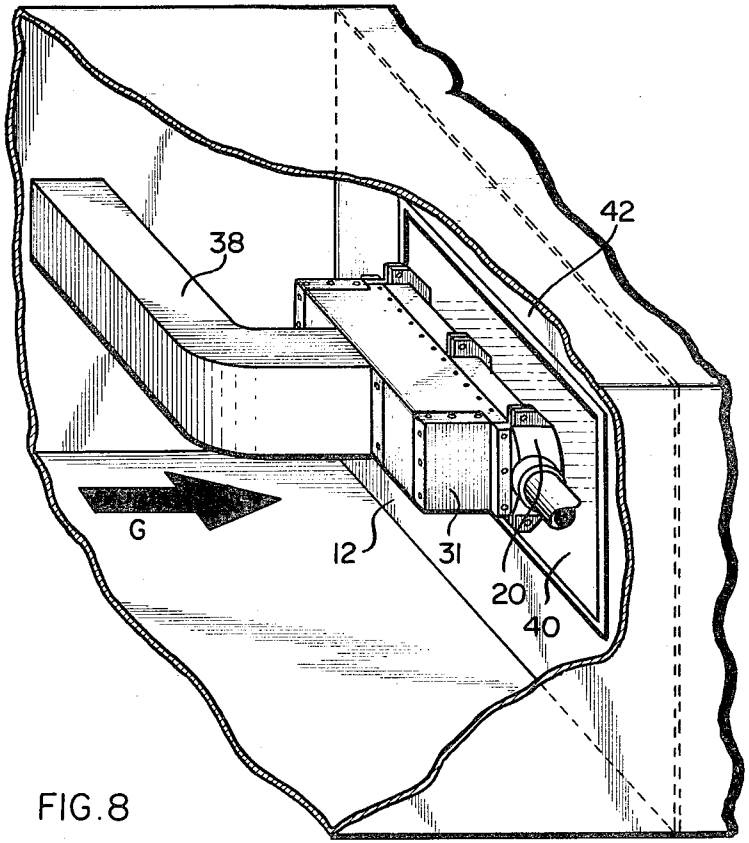
FIG. 8 is yet another embodiment of the improved nozzle mixing line burner of the present invention including an air manifold installed within the effluent stream which is poor in oxygen but of sufficient velocity such that no blower is required.

In alternative embodiments, such as especially FIGS. 6 and 8, an air duct 38 is connected to the air manifold 31 at a point preferably approximately equidistant the longitudinal ends of the burner 12 for enhancement of the uniformity of air flow along the length of burner 12.

The functioning of nozzle mixing line burner 12 to produce a flame is illustrated particularly in FIG. 5. Therein, combustion air, as shown at Arrows E, exits air manifold 31 and proceeds to orifice plate 22, as shown at Arrows C, where the air enters a gas/air mixing zone 38 where it is mixed with gas entering mixing zone 38 through gas orifices 18 as shown at Arrows A. The gas/air mixture flows upwardly as shown at Arrows F where combustion occurs. The improved nozzle mixing line burner of the present invention finds wide application, either internal or external to the firing duct, where the effluent stream is of sufficient velocity or insufficient velocity to provide ample air flow, and where the effluent stream is sufficient or insufficient in supplying oxygen for combustion.

In the embodiment of FIG. 6, the improved nozzle mixing line burner of the present invention 12 is shown mounted within a slot 40 within the heated air duct 42. The same is shown with regard to FIGS. 7, 8, and 9. In each instance, the direction of the effluent is shown at Arrow G. In the embodiment of FIG. 6 an air duct 38 is provided to communicate an externally mounted blower 44 (shown in phantom lines) for providing sufficient oxygen to the oxygen poor effluent of this embodiment to provide combustion.

Figure 7:
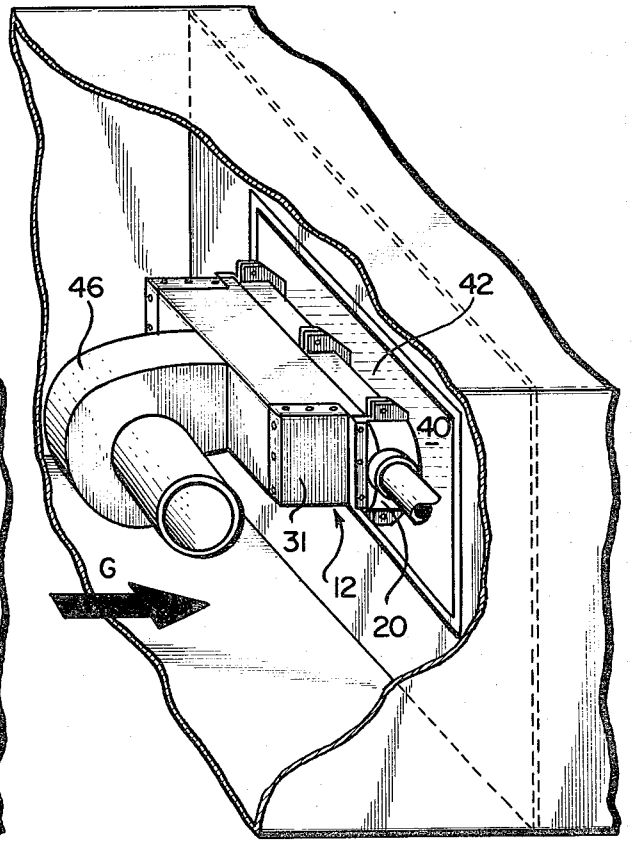
FIG. 7 is another embodiment of the improved nozzle mixing line burner of the present invention installed within the effluent stream and including an air manifold and a blower suitable for use in systems with an effluent stream which is rich in oxygen.
Figure 9:
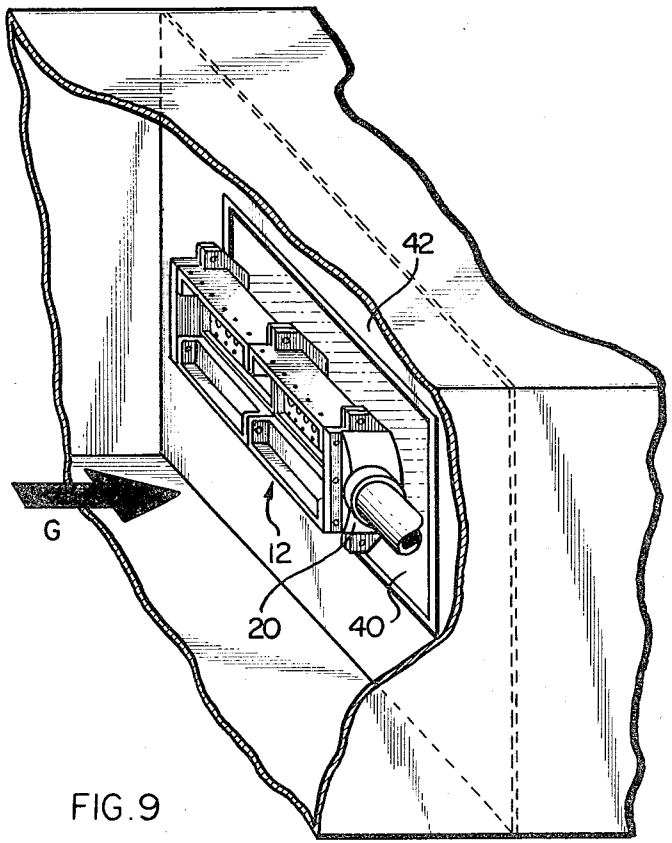
FIG. 9 is a yet further alternative embodiment of the improved nozzle mixing line burner of the present invention without an air duct which is suitable for use where the effluent stream is both of sufficient velocity and sufficiently enriched in oxygen.
Figure 11:
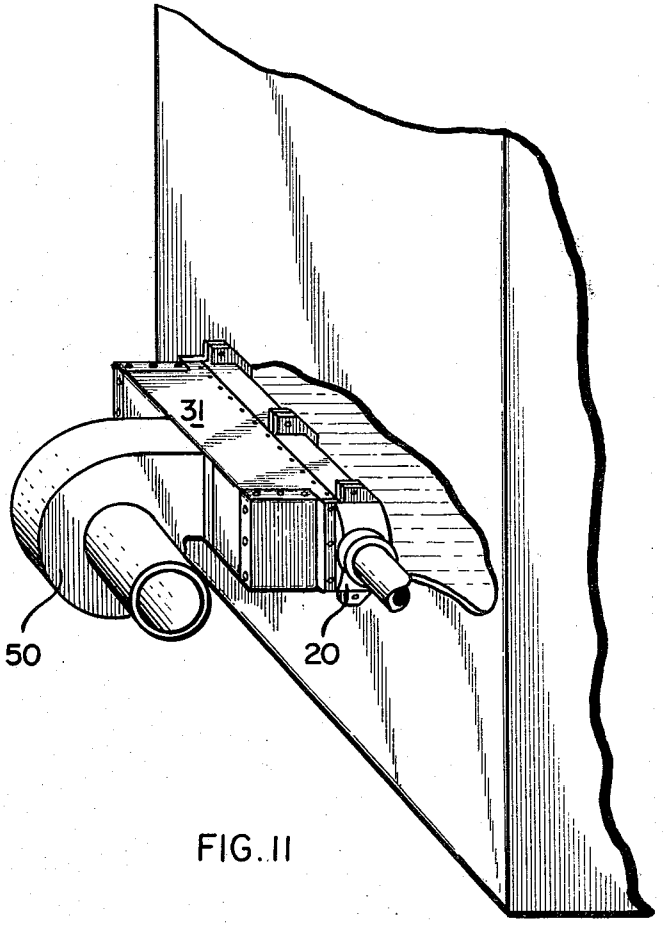
FIG. 11 is a yet further additional alternative embodiment similar to FIG. 10 but wherein the velocity of the air stream is insufficient and therefore a blower is required.
Figure 10:
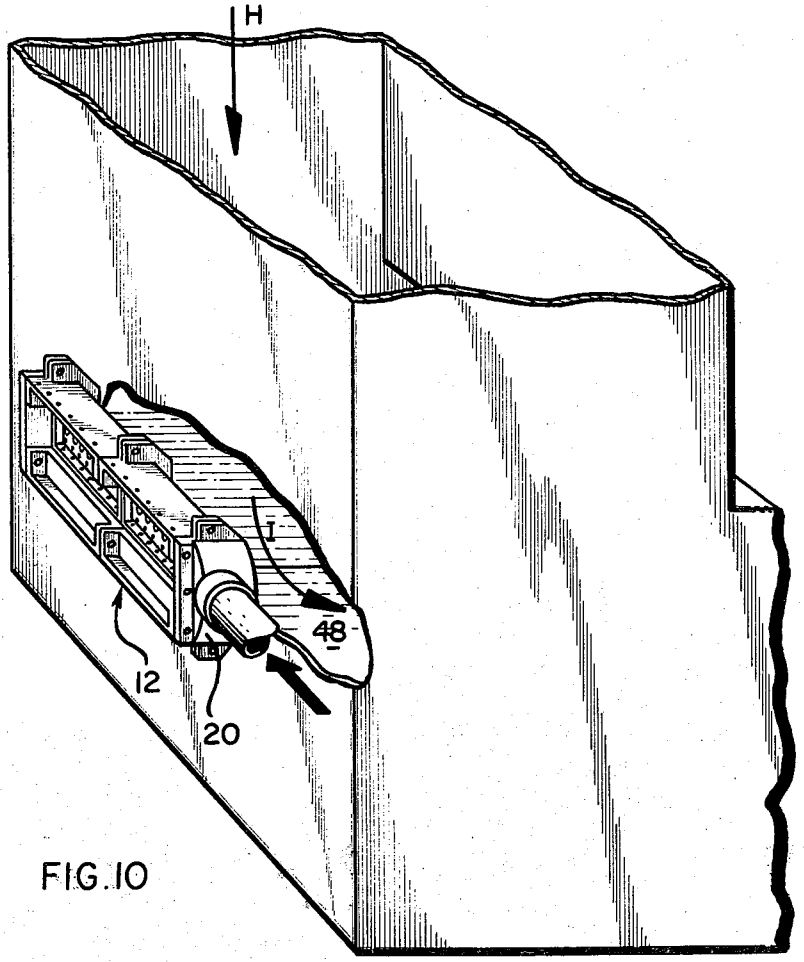
FIG. 10 is a yet further alternative embodiment of the improved nozzle mixing line burner of the present invention installed external to the firing duct, wherein the effluent stream is of sufficient velocity such that a blower is not required.

In the embodiment of FIG. 7, the effluent has sufficient oxygen to provide combustion, wherefore the blower 46 may be mounted internally of the duct. In the embodiment of FIG. 8, the effluent stream, although poor in oxygen and thereby requiring communication with external air as shown at air duct 38, the air stream is sufficient in velocity such that no blower is required. In the embodiment of FIG. 9, no blower, air duct or air manifold is required, inasmuch as the effluent air is of sufficient velocity and has a sufficient oxygen content. In the embodiments of FIGS. 10 and 11, the improved nozzle mixing line burner of the present invention 12 is shown exterior the the effluent air duct and at right angles to the direction of effluent air as shown at Arrow H of FIG. 10. In the embodiment of FIG. 10, the effluent air velocity is sufficient such that no blower means, air duct, or air manifold is required. In this embodiment, the effluent air travels downwardly and at right angles to the flame emitting from the improved nozzle mixing line burner of the present invention 12 and is directed 90 degrees as shown at Arrow I of FIG. 10, to travel along the heated air duct 48. In the embodiment of FIG. 11, an external blower 50 is utilized for increasing the air velocity where the improved nozzle mixing line burner of the present invention 12 is mounted externally to the heated air duct.

Of course, the gas manifolds 14, 16 and the orifice plate 22, being in proximity to the flame, as shown at Arrows F of FIG. 5, must be formed of a noncombustible and stable material, such as metal. Sheet metal is preferred for the construction of air manifold 31 and the various blower parts. Of course, a variety of fastening means may be used in regard to various embodiments of the present invention. In FIG. 1, bolts 52 are shown for connecting manifold parts together. Rivets 54 are shown for attaching the air duct 31 to the lower portion 55 of the manifolds 14, 16, although other fasteners, such as self-drilling and self-tapping screws, may be used.

The basic and novel characteristics of the improved nozzle mixing line burner of the present invention will be readily understood from the foregoing disclosure by those skilled in the art. It will become readily apparent that various changes and modifications may be made in the form, construction and arrangement of the improved nozzle mixing line burner of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. An improved nozzle mixing line burner for automatically increasing available oxygen for increased fuel gas flow rates, said burner comprising:

a pair of fuel gas manifolds oppositely disposed and in spaced relationship, each said fuel gas manifold extending longitudinally along the line of the burner, and each said fuel gas manifold having a plurality of fuel gas ports discharging laterally and toward the opposite manifold to provide streams of fuel gas;

means connected to said fuel gas manifolds for supplying a fuel gas thereto;

an orifice plate extending longitudinally along the line of the burner between said pair of fuel gas manifolds and upstream said fuel gas manifolds and having air orifices therein for providing streams of air transverse to said fuel gas streams directed laterally from said fuel gas manifold ports;

said air orifices comprising at least two rows of relatively smaller air orifices extending longitudinally along the line of the burner and relatively proximate each said fuel gas manifold, and further comprising at least one row of relatively larger air orifices longitudinally extending between said rows of relatively smaller air orifices, whereby as the velocity of the fuel gas flow is increased the laterally and internally directed streams thereof extend to the vicinity of said relatively larger air orifices to provide proportionately increased oxygen for the combustion of the increased fuel gas flow.

2. The improved nozzle mixing line burner of claim 1 further comprising supplemental air means for supplying supplemental air to said orifices of said orifice plate.

3. The improved nozzle mixing line burner of claim 2 wherein said supplemental air means comprise means defining an air manifold longitudinally extending along the line of the burner for directing air to said orifices of said orifice plate, and blower means connected to said air manifold for supplying air thereto.

4. The improved nozzle mixing line burner of claim 3 wherein said supplemental air means further comprise air diffuser means disposed within said air manifold for controlled and even flow of air to said air orifices of said orifice plate.

5. The improved nozzle mixing line burner of claim 4 wherein said air diffuser means comprises a diffuser plate extending longitudinally and along the line of the burner, said diffuser plate disposed upstream said air orifices and having a multiplicity of perforations therein and extending along the length thereof for promoting uniformity of air flow to said orifices.

6. The improved nozzle mixing line burner of claim 3 wherein an air duct is connected to said air manifold approximately equidistant the longitudinal ends of the burner for enhancement of uniformity of air flow along the length of the burner.

7. The improved nozzle mixing line burner of claim 1 wherein said fuel gas ports discharging from each said gas manifold are disposed in at least one facing pair of rows.

8. The improved nozzle mixing line burner of claim 7 wherein said fuel gas ports discharging from each said gas manifold are disposed in a single row on each gas manifold facing a single row on the oppositely disposed gas manifold, each said row disposed at substantially the same distance from said orifice plate.

9. The improved nozzle mixing line burner of claim 1 wherein each said gas manifold has substantially the same number of gas ports and each of said gas ports is of substantially the same size.

10. The improved nozzle mixing line burner of claim 1 wherein each of said gas ports is substantially circular in shape.

11. The improved nozzle mixing line burner of claim 1 wherein said relatively larger air orifices comprise two rows each extending longitudinally between said rows of said relatively smaller air orifices.

12. The improved nozzle mising line burner of claim 11 wherein said air orifices comprise two rows of longitudinally extending yet larger air orifices, said yet larger air orifices being larger than, and located between, said rows of said relatively larger air orifices.

13. The improved nozzle mixing line burner of claim 1 wherein the lateral dimension of each said relatively smaller air orifice and each said relatively larger air orifice are disposed in straight line configuration with respect to each other to form a pair.

14. The improved nozzle mixing line burner of claim 13 wherein the straight line configuration of each said pair of orifices is disposed beneath a corresponding gas stream from an adjoining fuel gas port to provide oxygen in proper amount for combustion thereof.

* * * * *